US005320334A

United States Patent [19]

DeAngelis

[11] Patent Number: 5,320,334

[45] Date of Patent: Jun. 14, 1994

[54] METHOD OF PRINTING A BOOK HAVING PAGES OF NEWSPRINT AND PAGES OF COATED ENAMEL PAGES

[76] Inventor: Andrew V. DeAngelis, 164 Kirkwood Ct., Bloomfield Hills, Mich. 48304

[21] Appl. No.: 902,840

[22] Filed: Jun. 23, 1992

[51] Int. Cl.[5] ..... B41F 13/58; B42D 1/00

[52] U.S. Cl. ..... 270/4; 270/10; 270/21.1; 270/37; 281/15.1; 283/56

[58] Field of Search ..... 270/1.1, 4, 5, 6, 7, 270/8, 9, 10, 18, 19, 20.1, 21.1, 37, 38, 43, 44; 283/56; 281/15.1

[56] References Cited

U.S. PATENT DOCUMENTS

| | | | |
|---|---|---|---|
| Re. 26,049 | 6/1966 | Fischer et al. | 283/56 |
| 429,891 | 6/1890 | Crowell . | |
| 804,293 | 11/1905 | Wood . | |
| 882,800 | 3/1908 | Scott . | |
| 890,720 | 6/1908 | Southgate | 270/5 |
| 1,109,152 | 9/1914 | Spalckhaver . | |
| 1,232,639 | 7/1917 | Wood . | |
| 1,436,818 | 11/1922 | Perkins | 283/56 |
| 1,970,929 | 8/1934 | Wood . | |
| 2,003,639 | 6/1935 | Wood . | |
| 2,016,309 | 10/1935 | Zuckerman | 270/11 |
| 2,025,927 | 12/1935 | Wood . | |
| 2,050,031 | 8/1936 | Wood | 270/5 |
| 2,160,527 | 5/1939 | Tornberg . | |
| 3,275,316 | 9/1966 | Cleary | 283/56 X |
| 3,582,111 | 6/1971 | Siiter | 283/56 |
| 3,588,085 | 6/1971 | Bailey et al. | 270/37 |
| 3,679,200 | 6/1972 | Bailey et al. | 270/37 X |
| 3,833,466 | 9/1974 | McCarty | 162/142 |
| 3,899,381 | 8/1975 | O'Brien et al. . | |
| 4,010,964 | 3/1977 | Schechter | 283/56 |
| 4,046,366 | 9/1977 | McCain et al. | 270/21.1 |
| 4,305,605 | 12/1981 | Vine | 281/35 |
| 4,420,147 | 12/1983 | Knox et al. | 270/37 |
| 4,682,767 | 7/1987 | Littleton | 270/45 |

*Primary Examiner*—Edward K. Look
*Assistant Examiner*—John Ryznic
*Attorney, Agent, or Firm*—Krass & Young

[57] ABSTRACT

A method and apparatus for forming books comprising pages of coated paper interspersed with pages of newsprint paper. The book is formed by providing a moving web of coated paper, providing a plurality of moving webs of newsprint paper, selectively perforating the moving web of coated paper in areas where coupons are to be provided, printing the moving web of coated paper with inks of a plurality of colors including printing within the coupon areas outlined by the perforating process, subjecting the moving web of coated paper to a heatset operation to set the inks on the web, printing the moving web of newsprint paper with at least one color ink, and associating the moving webs of coated paper and newsprint paper in a pasting, folding, and cutting operation to form a plurality of books each comprising a plurality of pages of coated paper interspersed with a plurality of pages of newsprint paper and adhesively bound together along one longitudinal edge of the book and each including detachable coupons on at least some of the coated paper pages.

19 Claims, 4 Drawing Sheets

METHOD OF PRINTING A BOOK HAVING PAGES OF NEWSPRINT AND PAGES OF COATED ENAMEL PAGES

FIELD OF THE INVENTION

This invention relates to printing methods and apparatus and more particularly to the formation of books comprising pages of coated paper interspersed with pages of newsprint paper.

BACKGROUND OF THE INVENTION

There is a need in the printing industry to provide a cost-effective means of providing individual books, each comprising a plurality of pages of coated paper interspersed with a plurality of pages of newsprint paper. Such a book may comprise for example a TV book provided in association with a newspaper. It is desirable in such a book to have several pages of coated paper included in the book to accommodate and attract advertisers desiring glossy, multicolor advertising entries. In the past these books have been provided by separately printing, folding, and cutting one or more coated webs, placing the coated products in inventory, separately printing, folding, and cutting one or more newsprint webs, placing the newsprint products in inventory, and thereafter, at a convenient time and place, bringing the coated and newsprint products together in a stapling operation to provide the final book. This separate printing of the coated and newsprint webs, followed by the final stapling of the coated and newsprint products together to form the book, is extremely expensive and time-consuming.

SUMMARY OF THE INVENTION

This invention is directed to the provision of an improved method and apparatus for forming books comprising pages of coated paper interspersed with pages of newsprint paper.

This invention is further directed to the provision of an improved method and apparatus for forming books containing pages of coated paper interspersed with pages of newsprint paper and further providing perforations on the interior coated pages of the book to facilitate the removal of coupons from the book.

According to the invention method, a moving web of coated paper is provided, a moving web of newsprint paper is provided, the moving web of coated paper is printed with multi-colored inks, the moving web of newsprint paper is printed with at least one color ink, and the moving webs of coated paper and newsprint paper are associated in a pasting, folding, and cutting operation to form a plurality of book, each comprising a plurality of pages of coated paper interspersed with a plurality of pages of newsprint paper and adhesively bound together along one longitudinal edge of the book. This method provides a simple and efficient means of providing a book including interspersed pages of coated and newsprint paper.

According to a further feature of the invention, at least two moving webs of newsprint paper are provided and the moving webs are delivered to the folder in vertically stacked relation with the coated web on top. This method provides a simple and efficient means of providing a booklet such as a television guide provided in association with a newspaper.

According to a further feature of the invention, each book has a front and rear cover page formed of coated paper and each book includes pages of coated paper interspersed between the cover pages with pages of newsprint paper. This arrangement provides attractive front and rear cover pages and further provides a plurality of coated pages within the book to facilitate advertising.

According to a further feature of the invention process, the moving web of coated paper is subjected to a heatset operation following the printing step and prior to the associating step. This methodology allows the moving web of coated paper to be immediately associated with the moving web of newsprint paper to facilitate the rapid and efficient production of the books.

According to a further feature of the invention process, the moving web of coated paper is further subjected to a perforating operation prior to the associating step to provide perforations around coupon areas on the coated web. This methodology further enhances the advertising appeal of the book.

The invention apparatus includes a source of a coated paper web, a source of a newsprint paper web, a plurality of printing units, a folder, a heatset unit, means defining a newsprint web path extending from the newsprint web source and through one or more printing units to the folder, and means defining a coated paper web path extending from the coated web source through one or more printing units, through the heatset unit, and thence to the folder for association with the moving web of newsprint paper.

According to a further feature of the invention apparatus, the moving web of coated paper is delivered to the folder in superimposed relation to the moving web of newsprint paper so as to facilitate provision of front and rear cover pages of the book of coated paper.

According to a further feature of the invention apparatus, the apparatus further includes a perforating unit and the moving web of coated paper is passed through the perforating unit to define perforations around coupon areas on the coated web. In the disclosed embodiment of the invention, the perforating unit precedes the printing unit for the coated web so that the perforating unit provides perforations around coupon areas on the coated web whereafter the printing unit prints coupon indicia within the coupon areas defined by the perforations.

The invention further defines a book comprising a plurality of pages of interspersed multicolor coated pages and newsprint pages adhesively bound along one of their common edges. In the disclosed embodiment, the book comprises front and rear cover pages formed of coated paper and each book further includes a plurality of pages of coated paper interspersed between the cover pages with pages of newsprint paper.

According to a further feature of the invention book, at least one of the coated pages within the book is provided with perforated coupons to facilitate the ready detachment of the coupons from the book.

DETAILED DESCRIPTION OF THE PREFERRED EMBODIMENT

Figure 1:
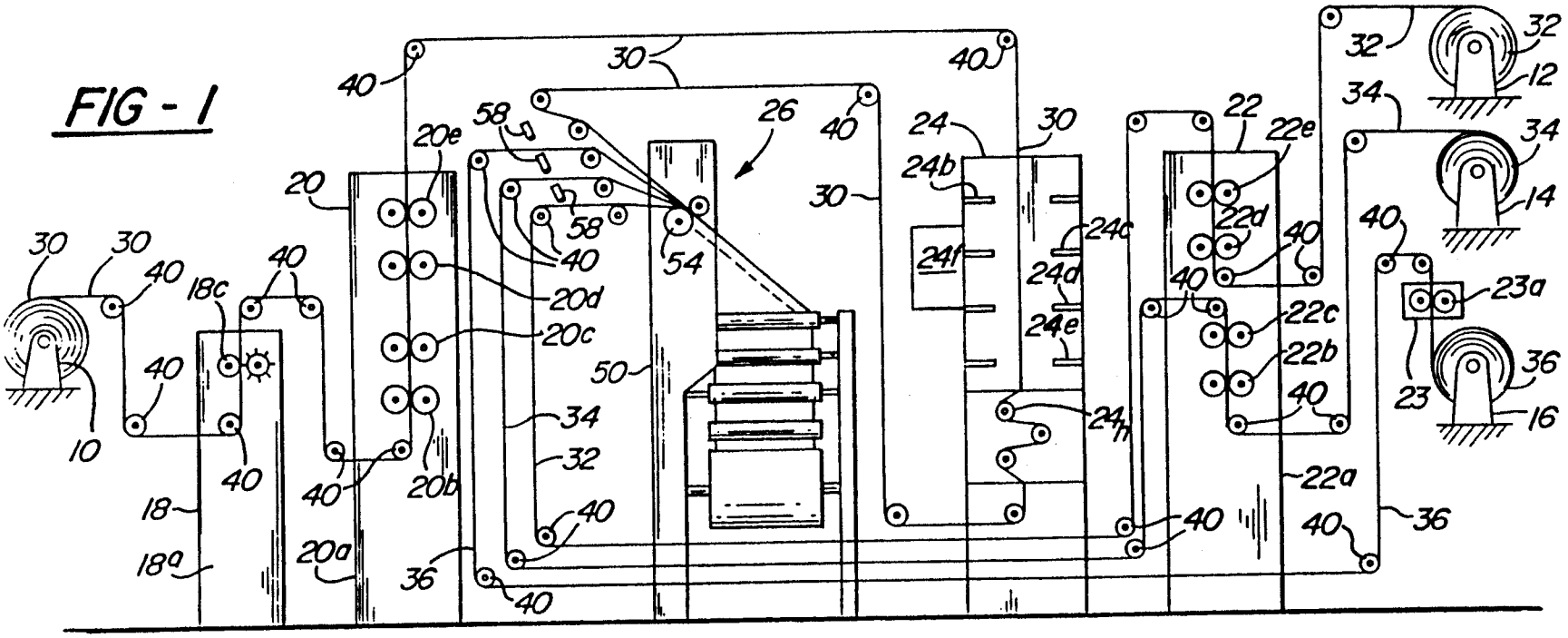
FIG. 1 is a somewhat schematic side elevational view of the invention printing apparatus.

The invention printing apparatus, broadly considered, includes web roll support stands 10, 12, 14, and 16; a perforating unit 18; printing units 20, 22, and 23; a dryer or heatset unit 24; a folder 26; and a trimmer 28.

A web roll 30 of coated paper is supported on web roll support stand 10; web rolls 32, 34, and 36 of newsprint paper are supported respectively on web roll support stands 12, 14, and 16; and a plurality of guide rollers 40 are provided to define the paths of the various webs as they move through the invention printing apparatus.

Web roll 30 may comprise, for example, a 34 inch wide web of 40 lb. No. 5 coated enamel groundwood paper and newsprint rolls 32, 34, and 36 may comprise 34 inch wide web rolls of 30 lb. groundwood newsprint.

Perforating unit 18 includes a housing 18*a*, a perforating roller 18*b*, and a backing roller 18*c*.

Printing unit 20 may comprise a "four-high" including a housing 20*a* and four vertically stacked printing couples 20*b*, 20*c*, 20*d*, and 20*e*. Printing unit 20 is preferably of the offset type.

Printing unit 22 may also be of the "four-high" offset type and includes a housing 22*a* and vertically stacked printing couples 22*b*, 22*c*, 22*d*, and 22*e*.

Heatset unit 24 includes a housing 24*a*, a plurality of sets of opposed nozzles 24*b*, 24*c*, 24*d*, and 24*e*, a source of hot air 24*f*, and a chill unit 24*g* including a plurality of chill rolls 24*h*. Heat source 24*f* may include an open gas flame providing heated air and a blower arranged to deliver the heated air to the nozzles 24*b*. Each chill roll 24*h* is hollow and is arranged to have refrigerant passed end to end through the chill roll in a closed loop manner with the refrigerant leaving one end of each chill roll and passing to a refrigeration unit 24*i* where it is cooled for resupply to the other end of the chill roll.

Folder 26 includes a housing and frame structure 50; a former 52; a roller-top-of-former 54; a pressure roller 56; adhesive nozzles 58; point-of-former rollers 60; nipper rollers 62; a cross-perforating roller 64 coacting with a backing roller 66; a cutting cylinder 68; a half-fold jaw cylinder 70; a rotary brush 72; a delivery board 74; a quarter folder 76; a delivery fly 78; and delivery belts 80.

Trimmer 28 is shown only schematically and includes an in-feed conveyor 90, a right angle transition conveyor 92, and trimming knives 94, 96, and 98.

The path of the coated web through the invention printing apparatus, broadly considered, extends from the coated web roll to the perforating unit 18 to the printing unit 20, to the heatset unit 24, to the folder 26, and thence to the trimmer 28. Specifically, coated web 30 extends from the coated web roll over guide rollers 40 and enters the perforating unit 18 where it passes upwardly through cylinders 18*b* and 18*c* to receive perforations on selected portions of the web; the web thereafter passes upwardly out of the perforating unit and around several guide rollers 40 to enter the lower end of printing unit 20 where it passes upwardly through the four printing couples 20*b*, 20*c*, 20*d*, and 20*e* to receive four different color impressions from the respective four couples; the web thereafter passes upwardly out of the printing unit and over guide rollers 40 and then downwardly into the heatset unit 24 where it is initially exposed to the nozzles 24*b* supplied with hot drying air from the heater unit 24*f* to heat the web and the ink lying on the coated surfaces of the web whereafter the roll passes downwardly over the chill rollers 24*h* where it is chilled to set the ink on the coated surface of the webs; the web thereafter leaves the lower end of the heatset unit and passes around guide rollers 40 and thence upwardly for entry into the folder 26 whereafter, after passage through the folder, the web is delivered to the trimmer 28 for suitable trimming operations.

The path of the newsprint web 32 through the invention apparatus, broadly considered, extends from the newsprint roll 32, through printing unit 22, through the folder 26, and thence to the trimmer 28. Specifically, newsprint web 32 extends from the roll around guide rollers 40 into the mid section of printing unit 22 where it passes upwardly through printing couples 22*d* and 22*e* to receive a black ink and a colored ink, whereafter the web leaves the upper end of the printing unit 22 and passes around guide roller 40 along a path extending downwardly and then beneath the folder 26 and then upwardly into the entry of the folder 26 for passage through the folder and thence to the trimmer 28.

The path of web 34 extends from roll stand 14, around suitable rollers 40 and into the lower end of the printing unit where it passes upwardly through printing couples 22*b* and 22*c* to receive a black ink and a colored ink, respectively, whereafter it passes out of the printing unit 22 and downwardly for passage beneath the folder 26 and thereafter moves upwardly for entry into the folder and passage through the folder to the trimmer 28.

Newsprint web 36 extends from roll stand 16 upwardly through the printing couple 23*a* of printing unit 23 where it receives a black ink whereafter the web passes upwardly out of the printing unit and then downwardly for passage beneath the folder 26 whereafter it moves upwardly for entry into the folder and passage through the folder to the trimmer.

Figure 1B:
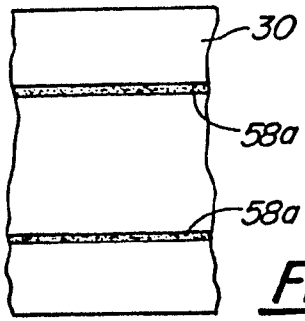
FIGS. 1A and 1B are fragmentary views of a coated web of paper moving through the invention printing apparatus.
Figures 3, 7:
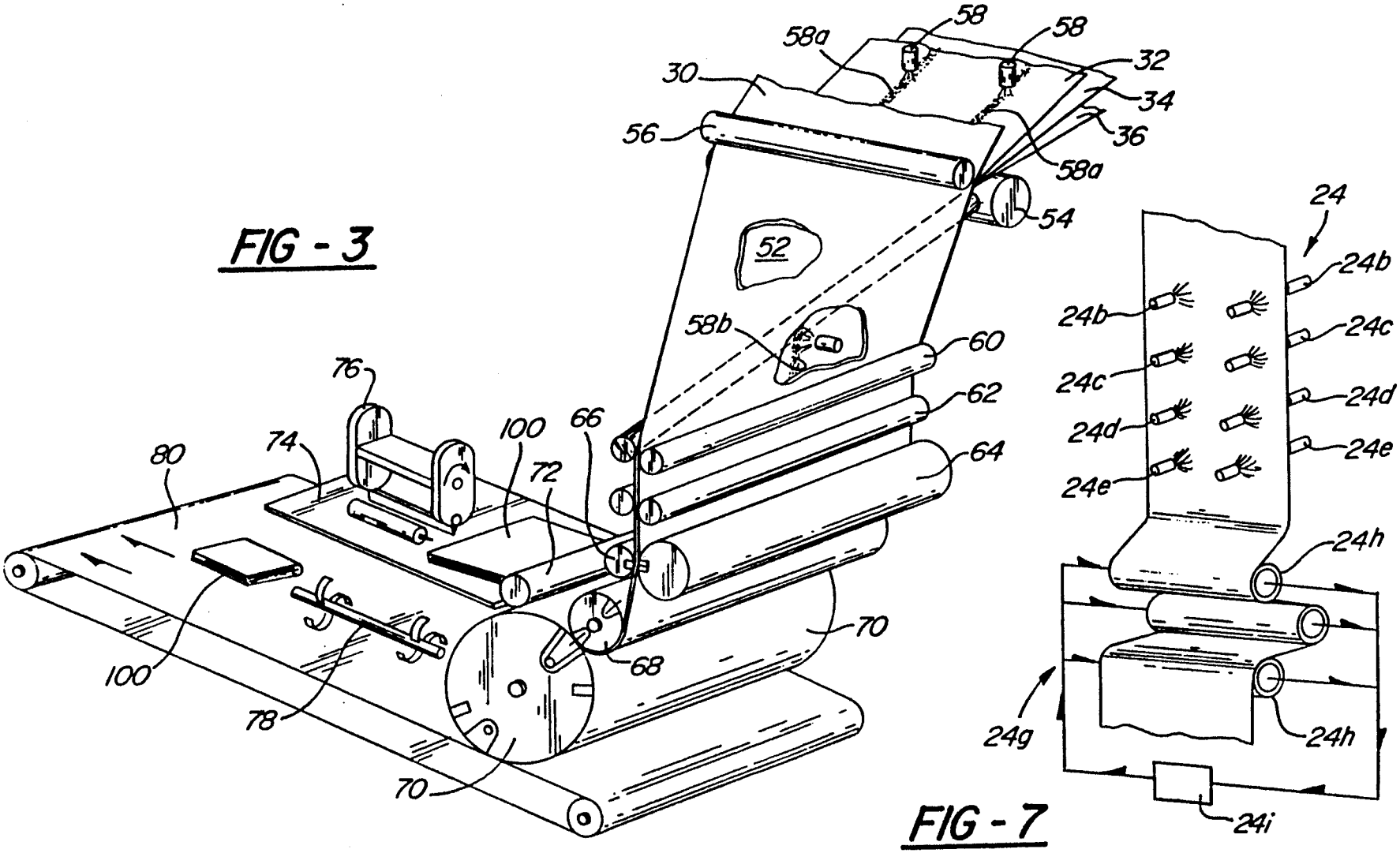
FIGS. 3 and 4 are fragmentary views of a folding unit employed in the invention printing apparatus.
FIG. 7 is a perspective fragmentary view of a dryer unit employed in the invention printing apparatus.
Figure 4:
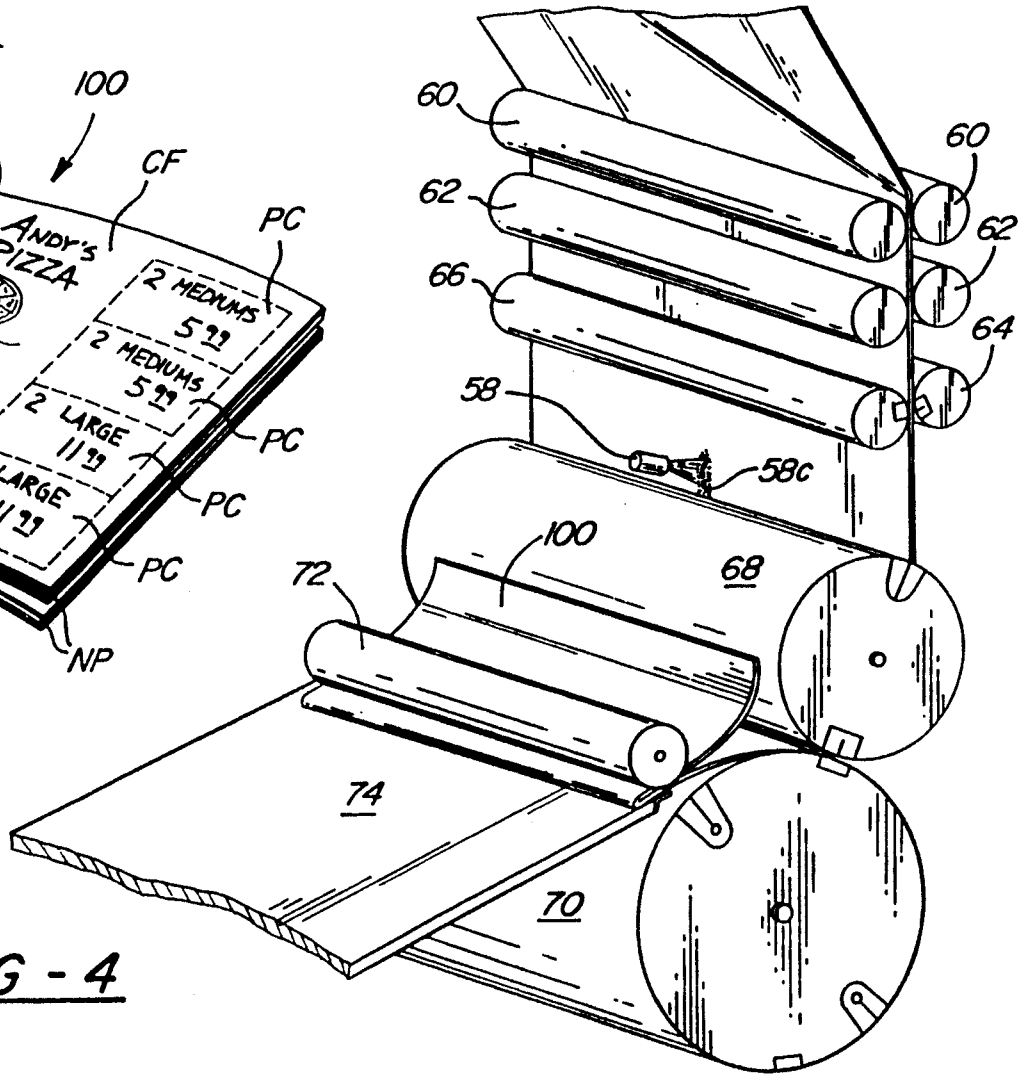

The webs 30, 32, 34, and 36 arrive at the entry to the folder in vertically stacked relation with the coated web 30 on top. As the superposed webs approach the top of former roller 54, each of the newsprint webs 32, 34, and 36 passes beneath two laterally spaced spray nozzles 58 which, as best seen in FIG. 3 and FIG. 1B, act to apply an adhesive or paste along longitudinal lines 58*a* on the respective webs. Page lines 58*a* are each spaced equidistant from the centerline of the web and a respective side edge of the web.

The superposed webs immediately thereafter pass between the former roller 54 and the pressure roller 56 where the webs are glued together along the glue lines 58*a*, whereafter the webs pass downwardly over the former 52. As the webs reach the nose 52*a* of the former, a first fold is made in the product along the longitudinal centerline of the webs. The rollers 60 guide the webs over the former nose and help to form the fold whereafter the folded webs travel between the nipping rollers 62 which put a sharp crease in the first fold. As the webs move downwardly from the triangular edges of the former to the rollers 60, a further spray nozzle 58 positioned beneath the former 52 between the two sides of the webs serves to apply a further adhesive line 58*b* to one of the inner web surfaces formed as the web is folded around the edges of the former. After the folded web leaves roller 62 it passes through cross-perforating roller 64 and receives a further adhesive line 58*c* from a further spray nozzle 58, whereafter it passes downwardly between cutting cylinder 68 and half jaw cylinder 70 where a tucker blade on the cutting cylinder coacts in known manner with movable and stationary jaws on the half fold cylinder to tuck or fold the web, whereafter with further relative rotation of cylinders 68 and 70, the cylinders coact in known manner to cut the web and form a book 100 which is thereafter, in coaction with fingers carried on the rear edge of the delivery board 74, passed upwardly between the rear edge of the delivery board and the roller 72 for passage on the board 74 to the quarter folder 76 which rotates in known manner and acts to put a final fold in the book, whereafter the book passes downwardly through an opening in the board 74 for delivery to fly 78 which deposits the book onto belt 80 which delivers the book to the delivery end of the folder. Folder 26 may for example comprise a Rockwell-Goss SSC Folder available from the Graphic Systems Division of Rockwell International of Chicago, Ill.

As the book leaves the delivery end of the folder, it is deposited on conveyor 90 of trimmer 28 and moved past cutter 94 which trims the face of the book, whereafter the book is deposited onto right angle conveyor 92 where it passes between trimmers 96 and 98 which respectively trim the head and foot of the book, whereafter the completed book is deposited in a suitable collection receptacle. Trimmer 28 may for example comprise a Model AGT 100 Series Trimmer available from AGE Corporation of York, Pa.

Figures 2, 6:
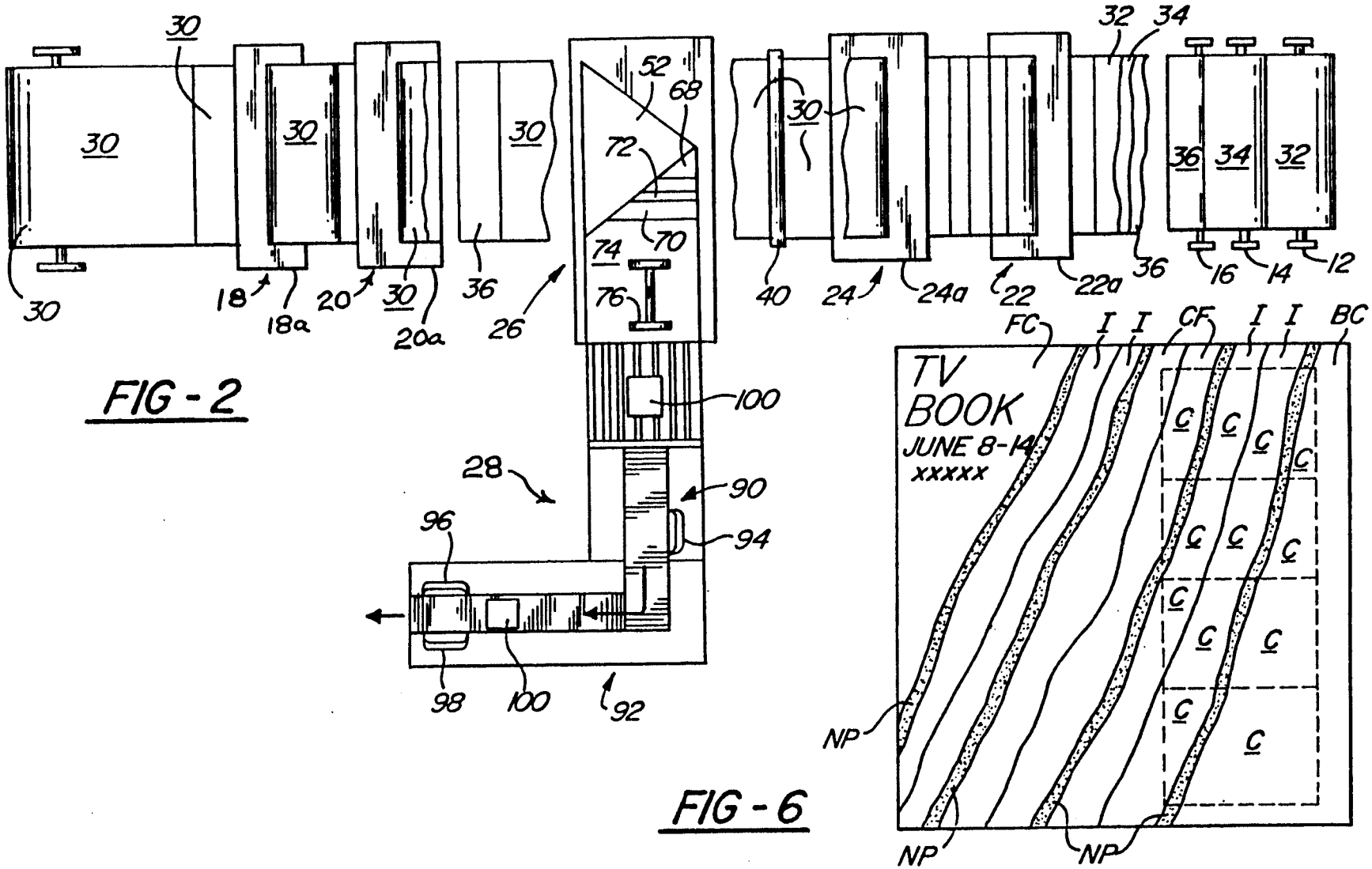
FIG. 2 is a somewhat schematic plan view of the invention printing apparatus.
FIGS. 5 and 6 are views of a book produced in accordance with the method and apparatus of the invention.
Figure 5:
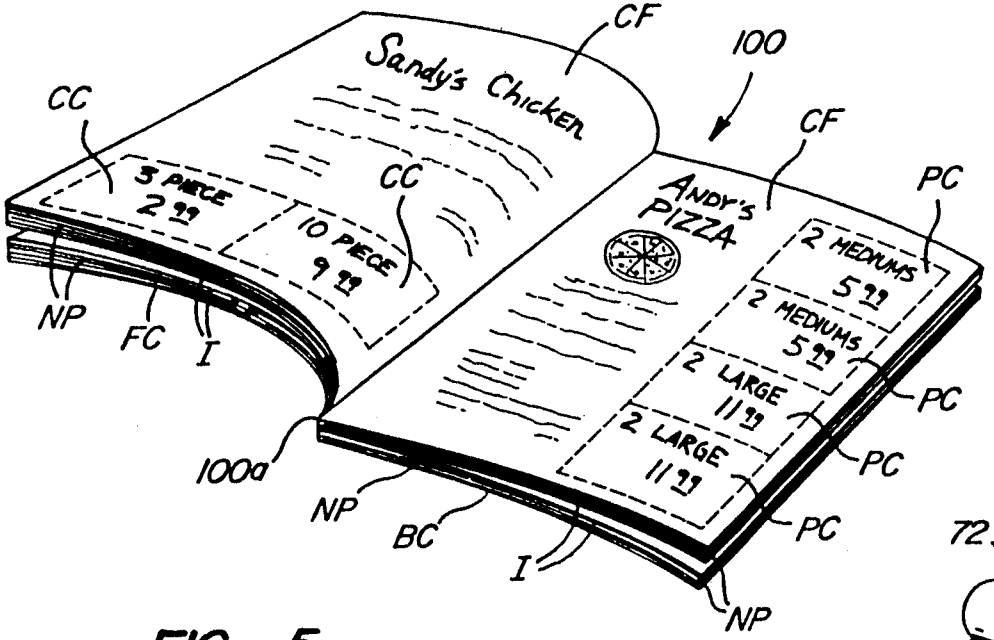

The completed book 100, as best seen in FIGS. 5 and 6, includes eight sheets, or sixteen pages, formed from the coated web interspersed between a plurality of sheets and pages formed from the various newsprint webs. Specifically, the book includes a front cover FC formed of coated paper; a back cover BC formed of coated paper; two centerfold sheets CF formed of coated paper; and inside sheets I formed of coated paper. The inside sheets I are positioned midway between the front cover and the respective centerfold sheet and the rear cover and the respective centerfold sheet with newsprint NP in between so that the book comprises a plurality of sheets of coated paper interspersed with a plurality of sheets of newsprint paper and adhesively bound together along one longitudinal edge 100*a* of the book.

Figure 1A:
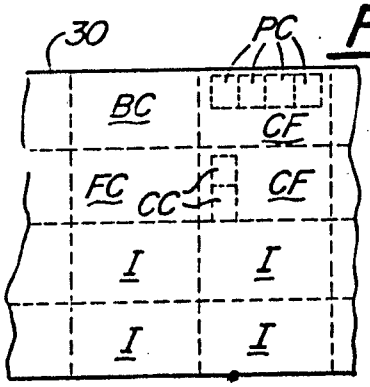

In addition to providing a book comprising a plurality of sheet of multicolor coated paper and a plurality of sheets of newsprint paper adhesively bound along a common longitudinal edge, the invention further enables the ready and selective provision of detachable coupons C on any or all of the pages of the sheets of coated paper. For example, with reference to FIGS. 1A and 5, the perforating unit 18 may be arranged such that a series of pizza coupons PC are provided on one of the pages of one of the centerfold sheets and a series of chicken coupons CC are provided on an opposing page of the other centerfold sheet. As seen in FIG. 1A, perforating roll 18*b* is configured to perforate the coated web passing thereby in a manner to provide four vertically stacked pizza coupon perforation outlined in a area of the web that will ultimately become one of the centerfold pages and to provide a series of perforations outlining a plurality of chicken coupons CC on the area of the web that will ultimately become the opposing centerfold page of the final book. Obviously, the perforating cylinder 18*b* may be arranged to provide perforated coupon areas at any of the areas of the coated web passing therebetween (including the areas BC, FC, CF, CF, III, and I) but it would ordinarily not be desirable to provide perforation areas on the area that will become the front cover to avoid defacing the front cover upon detachment of the coupons. It will of course be understood that the printing couples 20*b*, 20*c*, 20*d*, and 20*e* are arranged so as to print single color or multicolor coupon indicia within the areas outlined by the perforating roller 18*b* so as to provide the desired color and information within each coupon area outlined by the perforating roller.

Although the invention has been illustrated and described utilizing a coated web 30 having a width (for example 34 inches) equal to the width of the newsprint webs, the invention also has applicability to combinations wherein the coated web has a width less than the width of the newsprint. For example, as seen in FIG. 8, the invention method may be carrying out utilizing a coated web 30 having a width of 17 inches or half the width of the newsprint webs 32, 34, and 36 or, as seen in FIG. 9, having a width of 25½ inches or three-quarters the width of the newsprint webs 32, 34, and 36.

Figure 9:
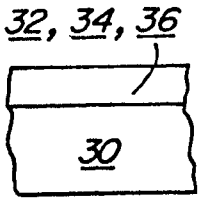
FIGS. 8 and 9 are fragmentary views of alternate web configurations.
Figure 8:
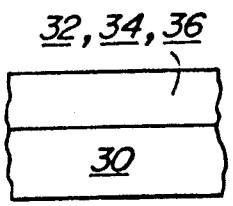

In the case of the half width web, as seen in FIG. 8, the coated web is positioned with one longitudinal edge in alignment with one longitudinal edge of the newsprint webs so that the other longitudinal edge of the coated web coincides with the centerline of the newsprint webs and in the case of the three-quarter width coated web, as seen in FIG. 9, the one longitudinal edge of the coated web is aligned with one longitudinal edge of the newsprint webs and the other longitudinal edge of the coated web is positioned midway between the centerline of the newsprint webs and the other longitudinal edge of the newsprint webs. It will be understood that the arrangement seen in FIG. 8 will produce a book having four sheets, or eight pages, formed of the coated paper, including the front and back covers and the centerfold, and that the arrangement of FIG. 8 will produce a book having six sheets of 12 pages of coated paper including the front and back cover, the centerfold, and two additional coated sheets positioned half way between the centerfold and either the front or rear cover.

The invention will be seen to provide a method and apparatus for producing a booklet of interspersed coated pages and newsprint pages in a cost-effective manner. More specifically, the invention will be seen to provide a method and apparatus for producing a book of interspersed coated and newsprint pages in which the book is produced in a total, continuous on-press run. The invention allows the ready and inexpensive provision of a book having a number of glossy coated pages so as to enhance the attractiveness of the book to advertisers by offering a relatively large quantity of glossy, four-color advertising space in a given size book. The invention method and apparatus further allows the ready provision of detachable coupons on the glossy, four-color advertising pages to further enhance the appeal of the book to advertisers.

Whereas a preferred embodiment of the invention has been illustrated and described in detail, it will be apparent that various changes may be made in the disclosed embodiment without departing from the scope or spirit of the invention.

I claim:

1. A method of forming a plurality of books comprising the steps of:

providing a moving web of coated enamel paper;

providing a moving web of groundwood newsprint paper;

printing the moving web of coated enamel paper with inks of a plurality of colors;

subjecting the printed moving web of coated enamel paper to a heatset operation;

printing the moving web of groundwood newsprint paper with at least one color ink; and thereafter associating the moving web of coated enamel paper and groundwood newsprint paper in a pasting, cutting and folding operation to form a plurality of books each comprising a front and rear cover page formed of coated paper, pages of newsprint paper between the cover pages, and inside pages of coated paper positioned between pages of newsprint paper with all of the pages adhesively bound together along one longitudinal edge of the book.

2. A method according to claim 1 wherein the heatset operation comprises passing the moving web of coated paper through an oven and subjecting the web to heated air during its passage through the oven.

3. A method according to claim 2 wherein the moving web leaving the oven is subjected to a chilling operation.

4. A method according to claim 3 wherein the chilling operation comprises passing the moving coated web over a plurality of chill rollers.

5. A method according to claim 1 wherein the moving web of coated paper is further subjected to a perforating operation, prior to the associating step, to provide perforations around coupon areas on the coated web.

6. A method according to claim 5 wherein the step of printing the moving web of coated paper comprises printing coupon indicia within the coupon areas.

7. A method according to claim 1 wherein the folding operation is performed by a folder and the moving webs are delivered to the folder with the coated web superposed to the newsprint web.

8. A method according to claim 7 wherein at least two moving webs of newsprint paper are provided and the moving webs are delivered to the folder in vertically stacked relation with the coated web on top.

9. A book comprising a plurality of pages of interspersed multi-color coated pages and newsprint pages adhesively bound along one of their common edges wherein each book has a front and rear cover page formed of multi-color coated paper, each book includes pages of coated paper interspersed between the cover pages with pages of newsprint paper, and at least one of the pages of coated paper interspersed between the cover pages with pages of newsprint paper includes perforations around coupons printed on the coated paper page so as to facilitate separation of the coupon from the coated page.

10. A book comprising a plurality of pages of interspersed multi-color coated enamel pages and groundwood newsprint pages formed by providing a moving web of coated enamel paper, providing a moving web of groundwood newsprint paper, printing the moving web of coated enamel paper with inks of a plurality of colors, printing the moving web of newsprint paper with at least one color ink, subjecting the printed moving web of coated enamel paper to a heatset operation, and thereafter associating the moving webs of coated enamel paper and groundwood newsprint paper in a pasting, folding, and cutting operation to form a plurality of books with each book comprising a front and rear cover page formed of coated paper, pages of newsprint paper between the cover pages, and inside pages of coated paper positioned between pages of newsprint paper.

11. A book according to claim 10 wherein the moving web of coated paper is further subjected to a perforating operation prior to the associating step to provide perforations around coupon areas on the coated web.

12. A method of forming a plurality of books comprising the steps of:

providing a moving web of coated enamel paper;

providing a plurality of moving webs of groundwood newsprint paper;

printing the moving web of coated enamel paper with inks of a plurality of colors;

subjecting the printed moving web of coated enamel paper to a heatset operation;

printing each of the moving webs of newsprint paper with at least one color ink;

positioning the moving webs in vertically stacked relation with the coated web on top; and associating the vertically stacked moving webs of coated paper and newsprint paper in a pasting, cutting, and folding operation to form a plurality of books each comprising a front and rear cover page formed of coated paper, pages of newsprint paper between the cover pages, and inside pages of coated paper positioned between pages of newsprint paper with all of the pages adhesively bound together along one longitudinal edge of the book.

13. A method for forming a plurality of books comprising the steps of:

providing a moving web of coated enamel paper;

providing a plurality of moving webs of groundwood newsprint paper;

subjecting the moving web of coated enamel paper to a perforating operation to provide perforations around coupon areas on the coated web;

printing the moving web of coated enamel paper with inks of a plurality of colors including printing coupon indicia within the coupon areas;

subjecting the printed moving web of coated enamel paper to a heatset operation;

printing each of the moving webs of groundwood newsprint paper with at least one color ink; and associating the moving webs of coated enamel paper and groundwood newsprint paper in a pasting, folding, and cutting operation to form a plurality of books each comprising a front and rear cover page formed of coated paper, pages of newsprint paper between the cover pages, and inside pages of coated paper positioned between pages of newsprint paper with all of the pages adhesively bound together along one longitudinal edge of the book and each including detachable coupons on at least some of the coated paper pages.

14. A method according to claim 13 wherein the perforated coupon areas are provided on one or more of the inside pages of coated paper positioned between pages of newsprint paper.

15. A printing apparatus comprising:

means defining a source of a web of coated enamel paper;

means defining a source of a web of groundwood newsprint paper;

means defining a folding location;

a plurality of printing units;

a heatset unit;

a chiller unit;

means defining a newsprint web path extending from the source of the newsprint paper through one or more of the printing units and thence directly to the folding location;

means for moving a newsprint paper web along the newsprint web path while printing the newsprint web in at least one color;

means defining a coated paper path extending from the source of coated paper to a plurality of printing units, thence to the heatset unit, thence to the chiller unit, and thence to the folding location;

means for moving a coated paper web along the coated paper web path while printing the coated paper web in a plurality of colors on the coated paper web and thereafter passing the printed coated paper web through the heatset unit and chiller unit to quickly dry the ink; and associating means, including a folder, positioned at the folding location and receiving the newsprint web and the coated paper web in superimposed relation, operative to associate the moving webs of newsprint paper and coated paper in a pasting, cutting, and folding operation to form a plurality of books each comprising a front and rear cover page formed of coated paper, pages of newsprint paper between the cover pages, and inside pages of coated paper positioned between pages of newsprint paper.

16. An apparatus according to claim 15 wherein the apparatus further includes a perforator and the coated paper web path extends through the perforator.

17. An apparatus according to claim 16 wherein the perforator is positioned in the coated paper path between the source of coated paper and the one or more printing units through which the web of coated paper passes.

18. An apparatus according to claim 15 wherein at least two sources of newsprint web paper are provided, each newsprint web moves from its respective source along a separate path to the folder, and the webs arrive at the folder in vertically stacked relation with the coated web on top.

19. An apparatus according to claim 16 wherein the perforating means provides perforations around coupon areas on the coated web and wherein, in each book, the coupon perforations are provided on one or more of the inside pages of coated paper positioned between pages of newsprint paper.

* * * * *